US008162678B2

(12) United States Patent
Wang

(10) Patent No.: US 8,162,678 B2
(45) Date of Patent: Apr. 24, 2012

(54) ELECTRICAL CONNECTOR HAVING BOARD ESCHEWING CAVITY

(75) Inventor: Wen-Fang Wang, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/013,728

(22) Filed: Jan. 25, 2011

(65) Prior Publication Data

US 2011/0294314 A1 Dec. 1, 2011

(30) Foreign Application Priority Data

May 31, 2010 (CN) ..... 2010 2 0209247

(51) Int. Cl.
*H01R 12/00* (2006.01)

(52) U.S. Cl. ..... 439/78; 439/76.1

(58) Field of Classification Search ..... 439/76.1, 439/78

See application file for complete search history.

(56) References Cited

U.S. PATENT DOCUMENTS

| | | | | |
|---|---|---|---|---|
| 4,938,701 | A * | 7/1990 | Heberling | 439/65 |
| 5,219,305 | A * | 6/1993 | Kawaguchi et al. | 439/620.12 |
| 5,266,054 | A * | 11/1993 | Duncan et al. | 439/620.12 |
| 5,509,825 | A | 4/1996 | Reider et al. | |
| 6,974,344 | B2 * | 12/2005 | Comerci | 439/329 |
| 7,819,685 | B2 * | 10/2010 | Hardell | 439/328 |
| 7,874,845 | B1 * | 1/2011 | Tang et al. | 439/65 |
| 2006/0160429 | A1 * | 7/2006 | Dawiedczyk et al. | 439/676 |
| 2011/0294314 | A1 * | 12/2011 | Wang | 439/78 |

* cited by examiner

*Primary Examiner* — James Harvey

(74) *Attorney, Agent, or Firm* — Wei Te Chung; Andrew C. Cheng; Ming Chieh Chang

(57) ABSTRACT

An electrical connector assembly includes a first electrical connector and a second circuit board mounted with a second electrical connector which is intended to mate the first connector, the first electrical connector further includes a recessed cavity to receive a board edge of the second circuit board when the first electrical connector is mated with the second electrical connector.

9 Claims, 6 Drawing Sheets

ELECTRICAL CONNECTOR HAVING BOARD ESCHEWING CAVITY

BACKGROUND OF THE INVENTION

1. Field of the invention

The present invention relates to an electrical connector, and more particularly, to an electrical connector having board eschewing cavity.

2. Description of the prior art

Currently, it is a significant trend in consumer electronic industry to provide products with smaller and smaller size, such as famous Apple's Mac Air, Amazon's Kindle and so on. Therefore, it's easy to realize that connectors used in these shrinking devices are also facing a need for smaller size, and the connector manufacturers are making every effort to reduce it.

Hence, an electrical connector with low profile is desired continually.

SUMMARY OF THE INVENTION

Accordingly, an object of the present invention is to provide an electrical connector which is compact in structure.

To fulfill the above-mentioned object, an electrical connector assembly includes a first electrical connector and a second circuit board mounted with a second electrical connector which is intended to mate the first connector, the first electrical connector further includes a recessed cavity to receive a board edge of the second circuit board when the first electrical connector is mated with the second electrical connector.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

Reference will now be made to the drawings to describe the present invention in detail.

Figure 1:
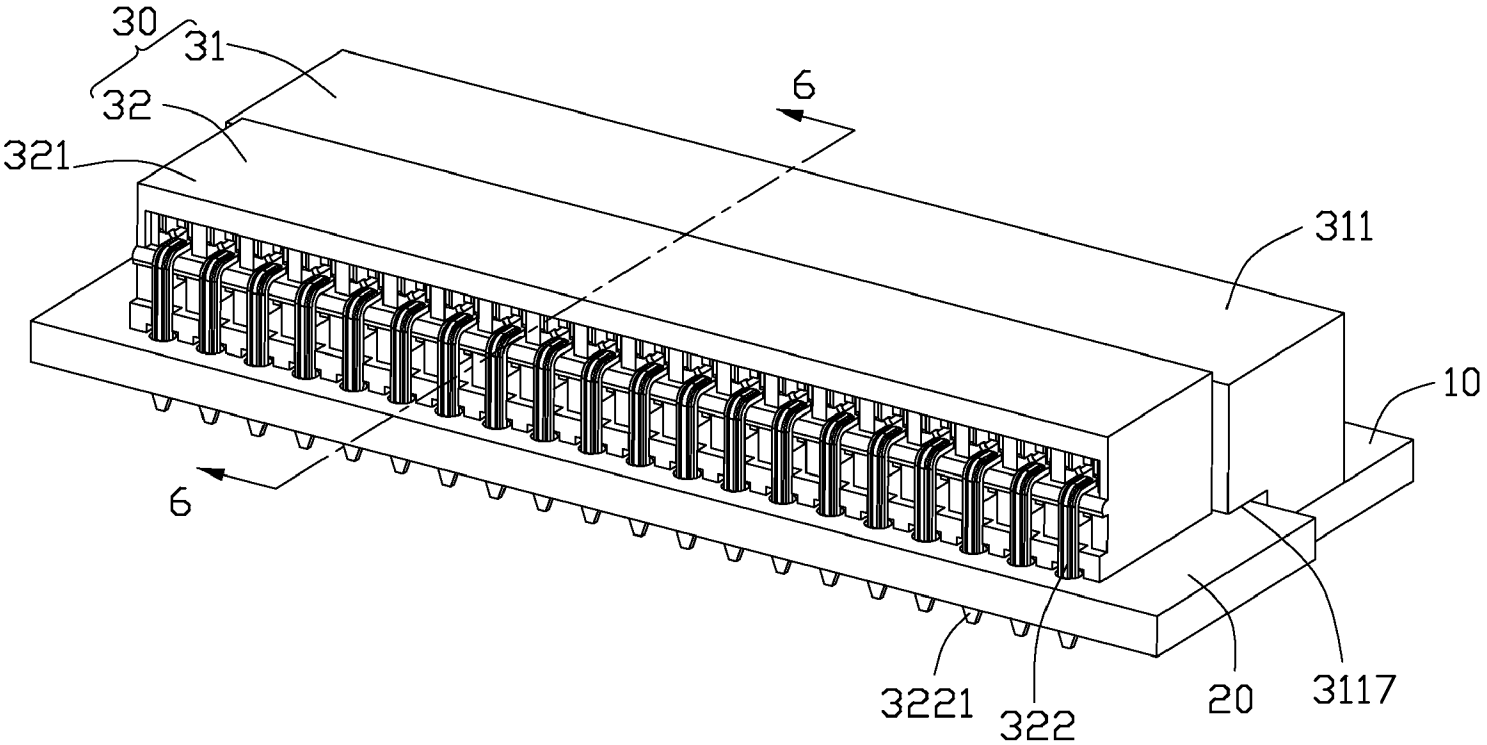
FIG. 1 is an assembled perspective view of an electrical connector assembly of an embodiment of the present invention.

Referring to FIG. 1, an electrical connector assembly 30 in accordance with the embodiment of the present invention is for electrically connecting a first circuit board 10 and a second circuit board 20. The assembly 30 comprises a first connector 31 mounted on the first circuit board 10 and a second connector 32 mounted on the second circuit board 20.

Figure 2:
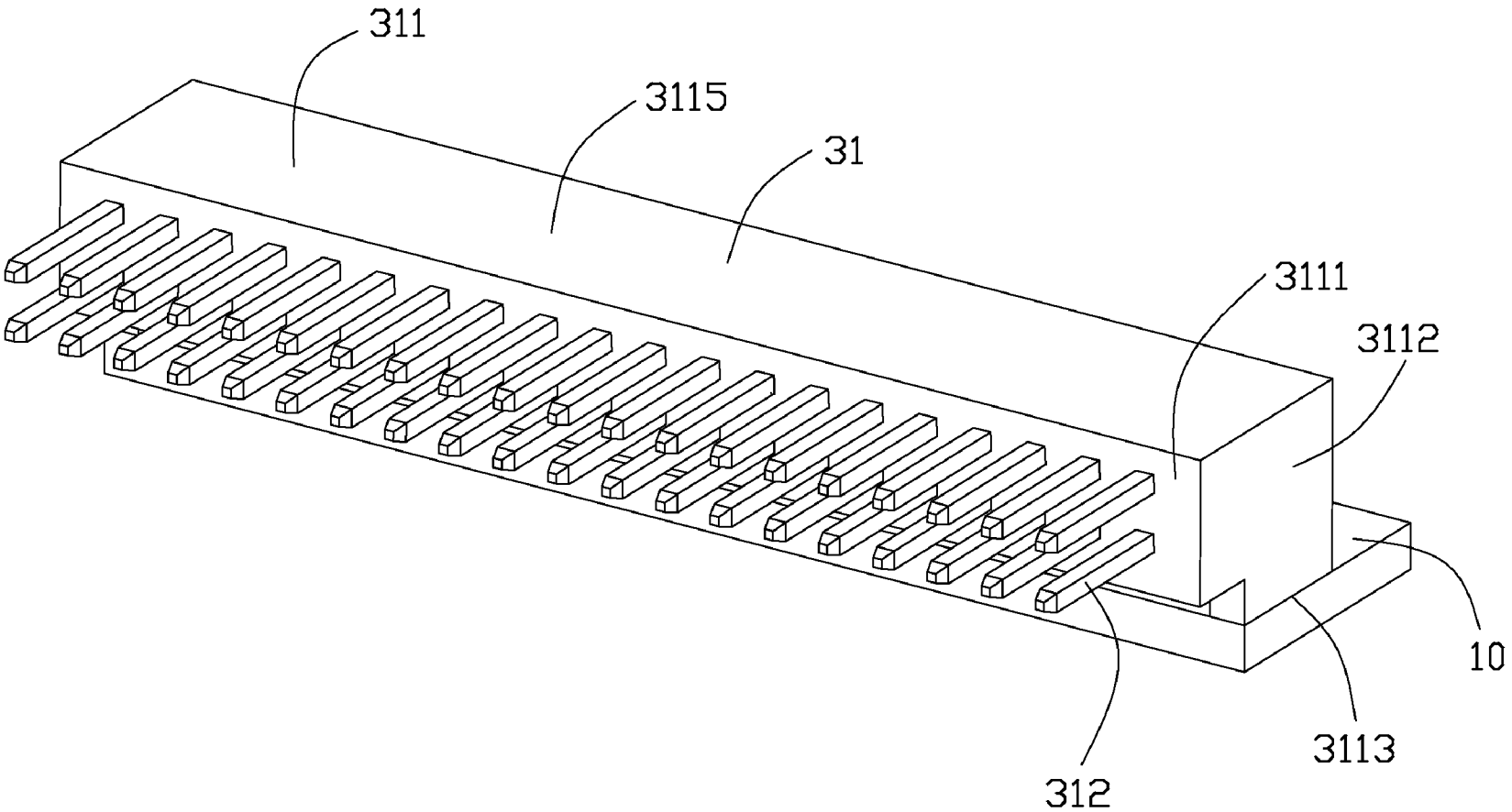
FIG. 2 is an assembled perspective view of a first electrical connector and a first circuit board as shown in FIG. 1.
Figure 3:
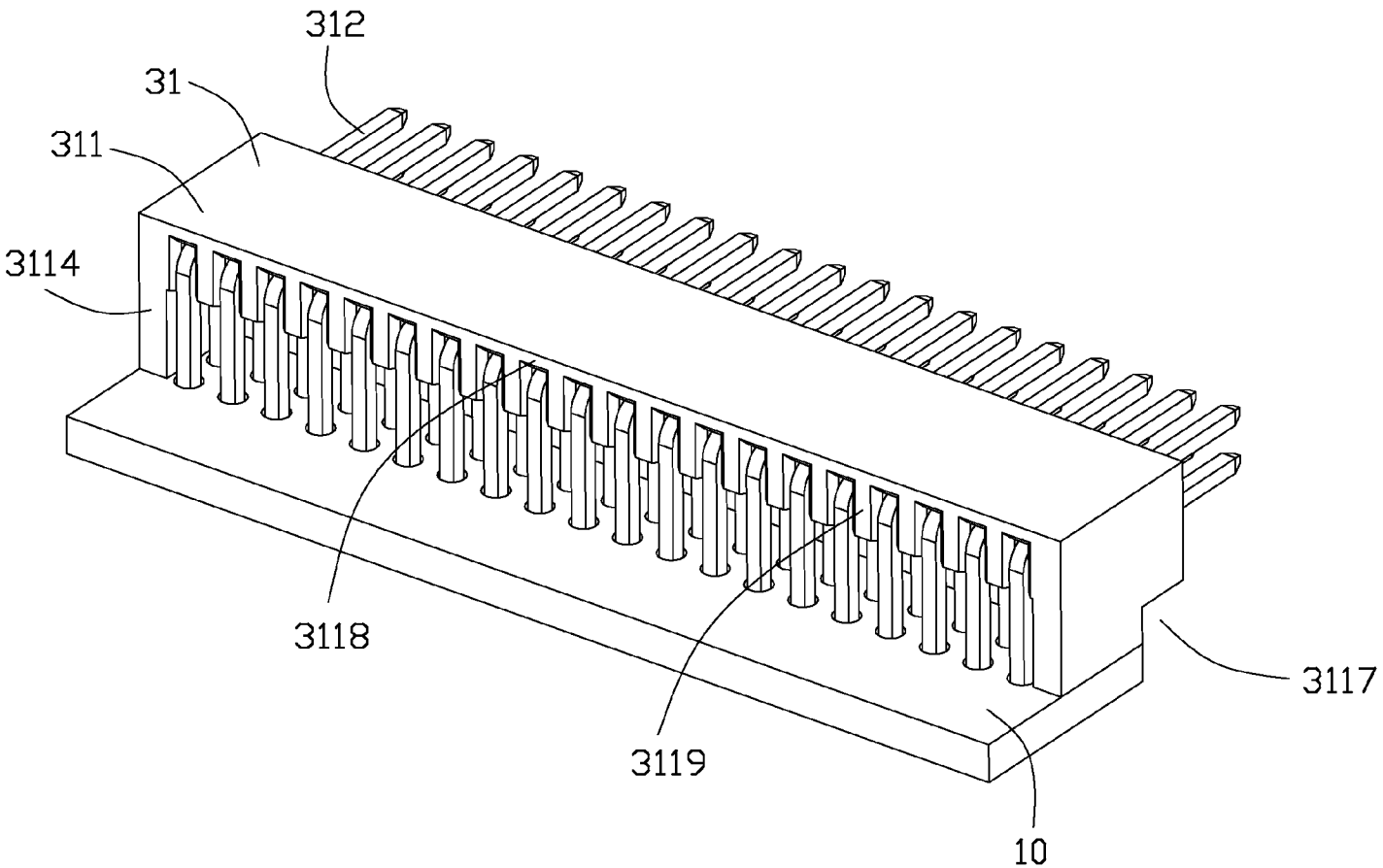
FIG. 3 is an assembled perspective view of the first electrical connector and the first circuit board from another view.
Figure 6:
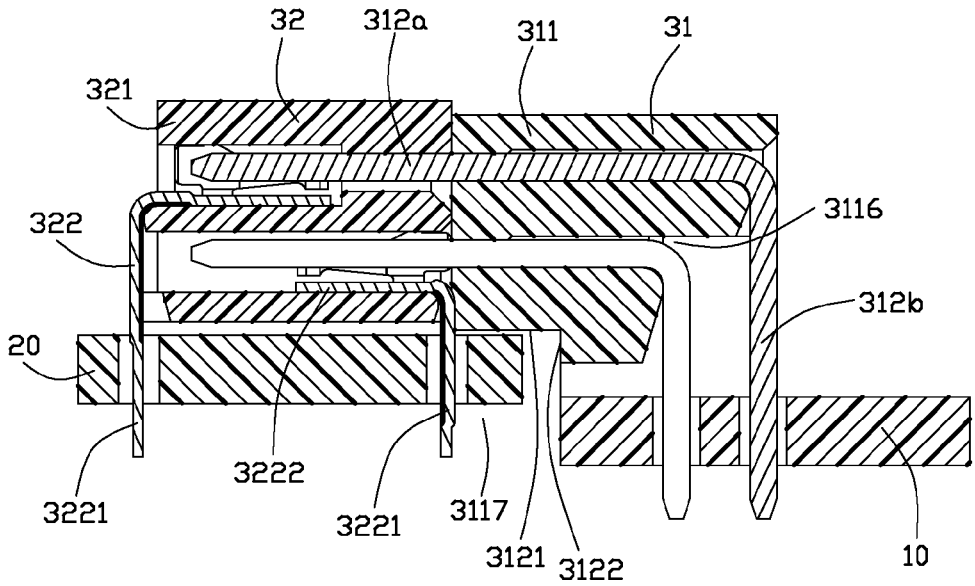
FIG. 6 is a cross section view of the assembly taken along a broken line 6-6 in FIG. 1.

Referring to FIGS. 2 to 3, the first connector 31 comprises an rectangular first insulative housing 311 and a plurality of first contacts 312 retained in the housing 311. The housing 311 defines a front mating face 3111 and an opposite rear face 3114, a mounting face 3113 and a top face 3115 opposite to the mounting face and a pair of side faces 3112 backwardly extending from both rectangular ends of the mating face 3111. Two rows of receiving slots 3116 labeled in FIG. 6 are arranged along a longitudinal direction and running through the mating face 3111 and rear face 3114. A recessed cavity 3117 is defined at the corner of the mating face and the mounting face along the longitudinal direction wholly. The recessed cavity 3117 is located below the receiving slots 3116. In this embodiment, the recessed cavity 3117 goes through the pair of side faces 3112 and defines a first face 3121 parallel to the mounting face and a second face 3122 perpendicular to the mounting face.

Figure 5:
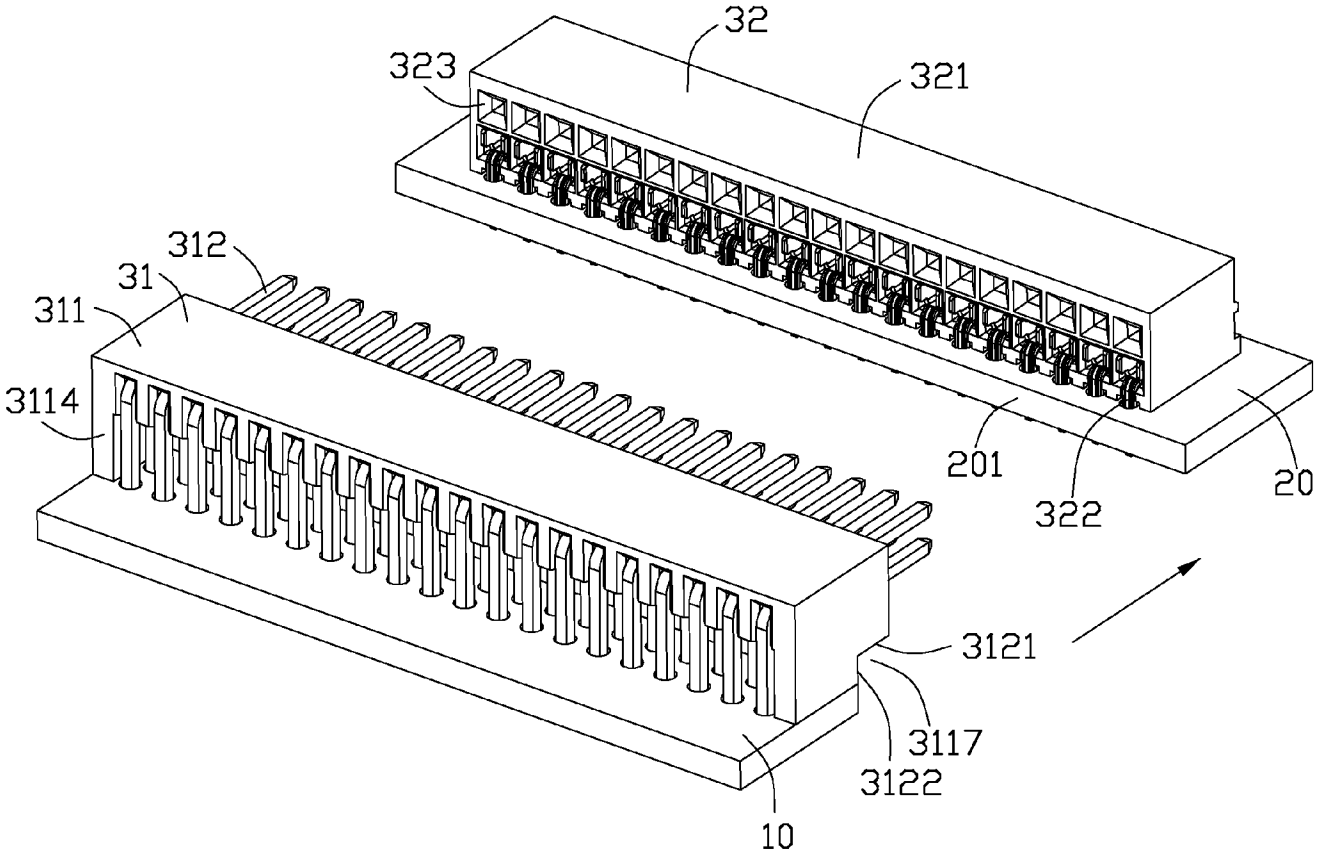
FIG. 5 is an perspective view of the electrical connector assembly as shown in FIG. 1 wherein the two connector disconnect from each other.

Combination with FIG. 6, each first contact 312 is generally in a L-shape and retained in the receiving slot, which comprising a horizontal section retained in the receiving slot with a mating section 312*a* extending forward beyond the mating face 3111 and a vertical soldering section 312*b* abutting against the rear face 3114 beyond the mounting face 3113. The first contact 312 in the upper row is longer in both horizontal section and vertical soldering section than that in the lower row for adapting the whole structure. The first contacts are inserted in the receiving slots from the rear face 3114. Please notes, the area around the receiving slots is depressed from the rear face 3114 and remain a periphery rib 3118 so that the solder section 312*b* hide in the housing, not beyond the rear face 3114. A plurality of partitioning short ribs 3119 extend downwards between every receiving slot for positioning the first contacts. The mounting face 3113 of the first connector 31 confronts with the first circuit board 10 so the connector is mounting on the first circuit board. In this embodiment, the circuit board 10 has a board edge in alignment with the second face 3122 of the recesses cavity 3117 as best shown in FIG. 5. Of course, any other embodiment with not aligned board edge is also practicable.

Figure 4:
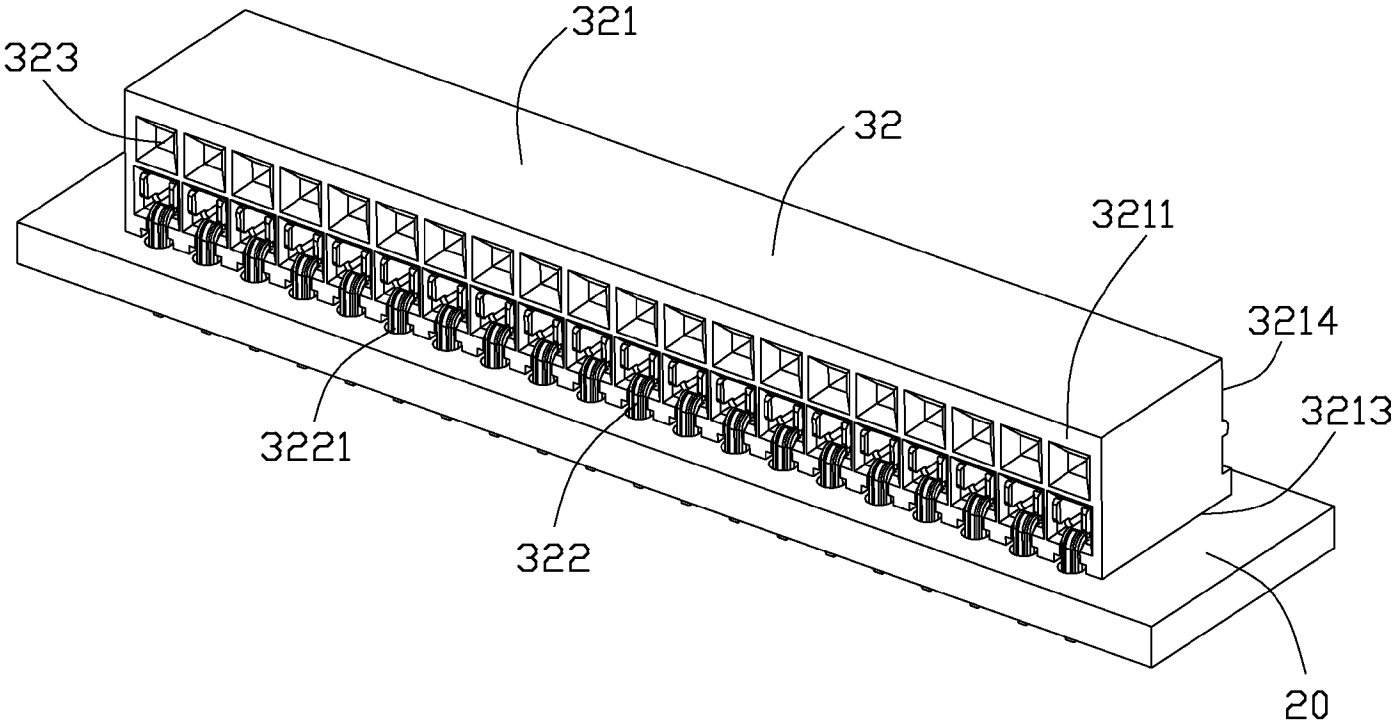
FIG. 4 is an assembled perspective view of a second electrical connector and a second circuit board as shown in FIG. 1.

Referring to FIGS. 4 and 6, the second connector 32 comprises an rectangular second insulative housing 321 and a plurality of second contacts 322 received in the housing 321. The housing 321 comprises a rectangular mating face 3211, an opposite rear face 3214 and a mounting face 3213 vertically to the mating face 3211. Two rows (upper row and lower row,) of mating slots 323 are depressed from the mating face 3211 and running through the rear face 3214. Best shown in FIG. 6, each of the second contacts 322 is also generally in an L-shape, which comprises a socket section 3222 receiving in the mating slots and a soldering section 3221. Please notes that each contact 322 in the lower row is inserted into the mating slots 323 from the mating face 3211 and leave the soldering section 3221 downwards extending along the mating face 3211, while each contact 322 in the upper row is inserted into the mating slots 323 from the rear face 3214 and leave the soldering section 3221 extending downwards along the rear face 3214. In order to form proper contact holes (not labeled) on the second circuit board to receive the second contacts 322 in the lower row, a board edge 201 of the second board 20 extends forwards beyond the mating face 3211 with a certain distance.

As best shown in FIGS. 5 to 6, the mating sections 312*a* of the first contact 312 are inserted into the mating slot 323 and makes electrically connection with the socket section 3222 of the second contact 322. The board edge 201 protruded beyond the mating face 3211 is just received in the recessed cavity 3117, the recesses cavity being functioned as a board eschewing cavity. Generally speaking, because of the recessed cavity, overall profile of the connector assembly can be reduced and the electrical connection can be enhanced.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

a first electrical connector;

a circuit board mounted with a second electrical connector which is intended to mate the first connector;

the first electrical connector defining a recessed cavity to receive a board edge of the circuit board when the first electrical connector is mated with the second electrical connector;

wherein the second electrical connector defines a mating face, a plurality of second contacts are received in the second electrical connector with soldering sections downwardly extending along the mating face.

2. An electrical connector assembly comprising:

a first electrical connector mounting upon an upper surface of a first printed circuit board, said first connector defining a first mating port;

a second electrical connector mounted upon an upper surface of a second printed circuit board essentially parallel to said first printed circuit board, said second connector defining a second mating port matable with the first mating port in a horizontal direction with an interface therebetween; wherein a front edge of the second printed circuit board extends beyond said interface in said horizontal direction and is essentially overlapped with a portion of the first connector in a vertical direction perpendicular to said horizontal direction.

3. The electrical connector assembly as claimed in claim 1, wherein a pair of side faces backwardly extend from both ends of the mating face and the recessed cavity goes through both side faces.

4. The electrical connector assembly as claimed in claim 3, wherein the recessed cavity is in a rectangular shape, defining a positioning face parallel to an upper surface of the circuit board and a limit face in front of the board edge when the two connectors are assembled together.

5. The electrical connector assembly as claimed in claim 3, wherein the first electrical connector is mounted on another circuit board which is parallel to the circuit board.

6. An electrical connector assembly comprising:

a first connector including an insulative housing seated upon a first board and defining a mating face and a mounting face joined with the mating face;

a plurality of contacts retained in the insulating housing and comprising pin shaped mating sections projecting beyond the mating face in a first direction;

a board eschewing cavity defined at a corner of the mating face and mounting face of the insulative housing;

a second connector mated with the first connector and seated upon a second board; wherein said second board extending toward and beyond the mating face in a second direction opposite to said first direction, is disposed adjacent the board eschewing cavity and lies in a plane parellel to and substantially above a plane defined by the first board.

7. The electrical connector assembly as claimed in claim 2, wherein said front edge of the second printed circuit board is not overlapped with the first printed circuit board in the vertical direction.

8. The electrical connector assembly as claimed in claim 2, wherein said second printed circuit board is higher than the first printed circuit board.

9. The electrical connector assembly as claimed in claim 8, wherein said first connector defines a cutout in a lower portion of a front face to receive said front of the second printed circuit board.

* * * * *